United States Patent [19]

Okada et al.

[11] 4,091,167

[45] May 23, 1978

[54] METHOD FOR PREPARING PAPER BOARD HAVING IMPROVED WET COMPRESSION STRENGTH

[75] Inventors: Toshio Okada, Kadoma; Hideharu Ohtsuki; Hiroshi Inagaki, both of Kyoto; Toshiaki Hanyuda, Yokohama; Masateru Tokuno, Nishinomiya; Seiichi Igarashi, Suita, all of Japan

[73] Assignee: Rengo Co., Ltd., Japan

[21] Appl. No.: 686,217

[22] Filed: May 12, 1976

Related U.S. Application Data

[63] Continuation of Ser. No. 506,053, Sep. 16, 1974, abandoned.

[30] Foreign Application Priority Data

Sep. 21, 1973 Japan ..... 48-105880

[51] Int. Cl.[2] ..... B05D 3/06

[52] U.S. Cl. ..... 428/413; 204/159.22; 260/837 R; 427/54; 427/44; 162/168 R

[58] Field of Search ..... 427/44, 54; 260/837; 204/159.22; 428/413

[56] References Cited

U.S. PATENT DOCUMENTS

| | | | |
|---|---|---|---|
| 3,367,992 | 2/1968 | Bearden | 427/54 |
| 3,408,422 | 10/1968 | May | 260/837 |
| 3,520,714 | 7/1970 | Miller | 427/44 |
| 3,600,290 | 8/1971 | Fitko | 427/44 |
| 3,683,045 | 8/1972 | Baldwin | 427/44 |

*Primary Examiner*—John H. Newsome

*Attorney, Agent, or Firm*—Wenderoth, Lind & Ponack

[57] ABSTRACT

This invention relates to a method for preparing paper board having excellent wet tensile strength and compression strength, which comprises (a) having paper board impregnated or coated with a mixture of an unsaturated vinyl ester prepolymer having a molecular weight of 300 to 3000 and having at least one hydroxyl group at the $\beta$-position with respect to an ester bond in the molecule with at least one monomer selected from the group of methylacrylate, ethylacrylate and butylacrylate in a mixing weight ratio of 10:90–40:60, and (b) irradiating the paper board having the resinous mixture with electrons to cure the resinous mixture.

7 Claims, No Drawings

METHOD FOR PREPARING PAPER BOARD HAVING IMPROVED WET COMPRESSION STRENGTH

This is a continuation of application Ser. No. 506,053, filed Sept. 16, 1974 now abandoned.

This invention relates to a method for preparing paper board having excellent dry and wet tensile strength and compression strength and useful as packaging paper. Particularly, this invention relates to a method for preparing paper board having excellent tensile strength and compression strength, which comprises (a) having paper board impregnated or coated with a mixture of an unsaturated vinyl ester prepolymer having a molecular weight of 300 to 3,000, preferably 500 to 2,000, and having at least one hydroxyl group at the $\beta$-position with respect to an ester bond in the molecule (hereinafter referred to as "prepolymer") with at least one monomer selected from the group of methylacrylate, ethylacrylate and butylacrylate in a mixing weight ratio of 10/90–40/60, and (b) irradiating the paper board having the resinous mixture with electrons to cure the resinous mixture on the surface and interior of the paper.

Heretofore, paper board has been used as packaging paper, but its use was limited since it was poor in water-resistance. Recently, packaging paper for vegetables, fruits, frozen fishes, fresh fishes and the like has been required which is highly water-resistant as a result of developments in delivery. More particularly, packaging paper having excellent stiffness and compression strength, especially in the wet state, is desired in order to prevent breakage during loading or transporting.

The conventional methods to impart water-resistance to paper board include (a) to impregnate or coat it with melted paraffin: (b) to impregnate or coat it with a resinous solution of vinyl polymer or the like; and (c) to impregnate it with an unsaturated compound and to polymerize the compound in the paper.

However, a method using melted paraffin has various disadvantages i.e. the melted paraffin discolors the paper and the surface of the paper coated with the paraffin becomes slippery. It is necessary to use a considerably large amount of paraffin in order to obtain a sufficient wet compression strength, and it is difficult to control the amount of paraffin to be applied.

In a method using a resinous solution of vinyl polymer or the like, it is also necessary to apply a considerably large amount of polymer in order to obtain the desired strength, and therefore selections of solvent and solution viscosity are difficult.

A method using an unsaturated compound comprises impregnating or coating paper board with an unsaturated compound such as methylmethacrylate, styrene, acrylonitrile and the like, or a mixture of the unsaturated compound and its polymer, and polymerizing these compounds in the paper by means of a redox type catalyst using ferous salt-hydrogen peroxide, ultraviolet-light radiation and high energy ionization radiation. Such a method has the disadvantage that when a sufficient amount of unsaturated compound to obtain the desired wet tensile strength and compression strength is applied to the paper, the dry folding strength is reduced, and breakage is easily caused during manufacturing cartons or corrugating the paper.

As a result of the study into improving the water-resistance of paper board by using the above-mentioned vinyl monomer or a mixture of vinyl monomer with polymer and polymerizing the resin by means of electron radiation using an accelerator, we have found that paper board having excellent wet tensile strength and compression strength as well as dry folding strength can be obtained by using a mixture of a prepolymer having a predetermined molecular weight and at least one monomer selected from methylacrylate, ethylacrylate and butylacrylate as claimed.

According to the present invention, it is possible to process paper board at a high speed at room temperature since electron radiation emitted from an accelerator is used. In addition to this advantage the paper board processed by this invention not only has excellent wet tensile strength and compression strength but also a considerable water absorption and dry folding strength as compared with the paper board processed by the conventional method using unsaturated compounds such as methylmethacrylate, styrene, acrylonitrile and the like.

A polymer formed by using methylmethacrylate, styrene or acrylonitrile in accordance with the conventional method has a glass transition temperature higher than room temperature, and is hydrophobic. It is therefore this polymer that is responsible for the wet tensile strength and compression strength of the processed paper. With regard to the compression strength, if the stiffness of the polymer at room temperature is higher, it is possible to obtain a predetermined compression strength by use of a smaller amount of polymer. However, such a polymer is generally brittle, and consequently the folding strength of paper processed by using this polymer is reduced. The folding strength is kept by using vinyl acetate, methylacrylate, ethylacrylate or the like which provides a polymer having a glass transition temperature lower than room temperature or by using a mixture of such a polymer or polybutadiene. Although the folding strength can be kept by the above-mentioned manner, the wet tensile strength and compression strength become poor. Thus, it is impossible to provide paper board having both satisfactory dry folding strength and wet compression strength in accordance with the conventional method.

We have discovered a resinous composition which imparts excellent wet tensile strength and compression strength to paper without reducing its folding strength. The resinous composition of this invention is prepared by mixing a prepolymer having a molecular weight of 300–3,000 with at least one monomer selected from the group of methylacrylate, ethylacrylate and butylacrylate in a weight ratio of 10/90–40/60.

When a sample paper board was processed in accordance with the conventional method by impregnating it with a methanol solution of methylmethacrylate and polymerizing the methylmethacrylate in the paper by means of electron radiation of 5 M rads emitted at a dose rate of 0.25 M rad/sec by a Van de Graaff electrostatic accelerator (1.5MeV, 50 $\mu$A), 33 g/m$^2$ of the polymer was required to obtain a wet ring crush strength of 10 kg (the test for ring cruch strength was carried out after it had been immersed in water at 20° C for 1 hour. Size of sample was 152.4 $\times$ 12.7 mm. The wet ring crush strength of untreated paper board was 2 kg. The dry folding strength (expressed by folding times required to break the test sample) of untreated board paper was 850 times, while that of the above-processed paper board was only 30 times.

The same test was carried out using styrene in place of methylmethacrylate. 18 g/m$^2$ of polystyrene was required to obtain a wet ring crush strength of 10 kg, and the dry folding strength was 100 times.

The test conducted using acrylonitrile gave almost the same results as those in the case of styrene.

Processed paper board is required to have a wet ring crush strength higher than 10 kg and folding strength more than 200 times in order to be durable enough for practical use.

As mentioned above, the conventional methods do not satisfy these requirements. Polystyrene is considerably effective as a polymer for improving the wet compression strength, but the rate of polymerization by means of radiation is very low. The rate of polymerization was only 65% even after being irradiated by 10 M rads of electron radiation at the above dose rate, and it was very difficult to polymerize completely. That is, styrene is not a suitable monomer to be polymerized by electron radiation. The rate of polymerization of acrylonitrile is considerably higher and becomes more than 90% with 5 M rads of electron radiation, but the surface of the paper treated with acrylonitrile was rough. Thus, acrylonitrile is quite unsuitable in order to obtain an even and smooth surface.

The paper board processed in accordance with the present invention does not have the above-mentioned disadvantages. That is, the paper board processed by being impregnated with a mixture of a prepolymer having a molecular weight of 2,000 and ethylacrylate in a weight ratio of 25/75 and being polymerized by 5 M rads of electron radiation required 9 g/m$^2$ of polymer to obtain a wet ring crush strength of 10 kg and dry folding strength of 360 times. The rate of polymerization of the mixture of prepolymer and ethylacrylate became more than 90% with 3 M rads of electron radiation. This means that this mixture is a suitable monomer to be polymerized by electron radiation. This is one of the main advantages of this invention.

Another characteristic of the paper board processed by using the mixture of prepolymer and ethylacrylate is that the paper thus processed is considerably more water absorbent in comparison with paper board processed by using methylmethacrylate, styrene or acrylonitrile in accordance with the conventional method. For example, the water absorption of untreated paper board is 64%. This water absorption was determined by the increase in the weight of the paper board after it was immersed in water at 20° C for 10 minutes. The water absorption of paper board treated with styrene or methylmethacrylate polymer in an amount of 10 g/m$^2$ is 30% or 32% respectively. On the other hand, paper board treated with a mixture of prepolymer and ethylacrylate (25:75) has a water absorption of 46%. Thus, although the paper board treated in accordance with the present invention has a relatively high water absorption, it has an excellent wet ring crush strength. When a styrene polymer is used, 18 g/m$^2$ of styrene polymer is required to obtain a wet ring crush strength of 10 kg, and the water absorption of the paper board thus treated is only 11%. This means that the paper board treated in accordance with this invention has a much higher water absorption than that of the paper board treated with styrene polymer in such an amount as to impart a satisfactory ring crush strength to the paper. According to the conventional general idea, it was considered to be necessary to reduce water absorption in order to increase compression strength. However, the paper board of this invention has a relatively high water absorption, and yet has excellent wet tensile strength and compression strength. Thus, the idea of this invention is quite different from the conventional conception.

According to the present invention, the amount of polymer required to give a satisfactory wet compression strength is considerably less than in the conventional process. Control of the amount of polymer used for coating can be made by diluting the polymer with solvent such as acetone, methanol or the like. A mixture of prepolymer and ethylacrylate is considerably viscous, and therefore it is preferably diluted in order to uniformly coat or impregnate paper board.

When prepolymer or methylacrylate, ethylacrylate or butylacrylate is used alone, a desired strength cannot be realized. The desired strength can be realized only when a mixture of prepolymer and at least one monomer selected from the group of methylacrylate, ethylacrylate and butylacrylate in a weight ratio of 10/90–40/60, preferably 20/80–30/70 is used. If the amount of prepolymer is increased above this value, the dry folding strength is reduced. On the other hand, if the amount of acrylate polymer is increased above this value it is difficult to obtain satisfactory wet compression strength.

The prepolymer used in this invention should have molecular weight of 300–3,000, preferably 500–2,000. If the molecular weight of the prepolymer is less than 300, the amount of polymer required to obtain a satisfactory wet compression strength is increased and the rate of polymerization of polymer by means of electron radiation is reduced. On the contrary, if the molecular weight of the prepolymer is higher than the above range, the polymer solution becomes too viscous to uniformly coat the paper and the amount of polymer required to give a satisfactory wet compression strength is increased.

The epoxyacrylate prepolymer having a molecular weight of 300–3,000 used in this invention has at least one epoxy group and one hydroxyl group, and at least one part of the molecule has the chemical structure defined as follows:

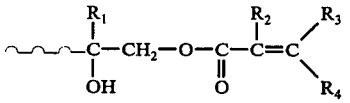

(wherein $R_1$, $R_2$, $R_3$ and $R_4$ are H or $CH_3$)

Such a prepolymer used in this invention has a chemical formula, for example,

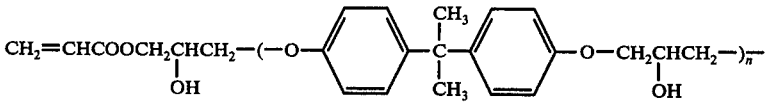

-continued

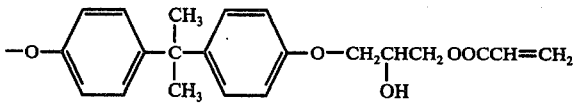

($n$ = 0, 1, 2 . . . )

The prepolymer which satisfies the above conditions includes glycidyl ether produced by reaction of epihydrin with polyhydroxyphenol; glycidyl ester produced by reaction of epihydrin with polyhydroxylalcohol or polyhydrin; the reaction product of at least one epoxy compound selected from epoxy compounds obtained by oxidizing a compound having a double bond with an unsaturated monobasic acid such as acrylic acid, methacrylic acid or the like; and the reaction product of polyhydroxyphenol or polycarboxylic acid with glycidyl acrylate or glycidyl methacrylate. The prepolymer used in this invention further includes modified epoxyacrylate as disclosed in Japanese Patent Publication No. 45-1465.

Electron radiation of 100 KeV–5 MeV, preferably 500 KeV–3 MeV emitted by a Van de Graaff electrostatic accelerator or insulating core transformer type accelerator is preferably used in this invention. The irradiation dose is not limited, but 0.3–10 M rads is generally used. Polymerization by means of electron radiation can be effected in a short time, and therefore according to the present invention paper board having excellent dry and wet compression strength can effeciently be produced in a short time.

This invention is further illustrated by the following Examples.

EXAMPLE 1

A liner board (220 g/m$^2$, thickness = 0.30 mm) of 120 × 70 mm was kept in an atmosphere of 65% relative humidity at 20° C until the weight becomes constant. The weight was 1.843 g. Bisphenol type diglycidyl ether ("Epikote 1001" sold by Shell Chemical Corp.) was reacted with acrylic acid in the presence of a polymerization inhibitor and esterification catalyst to produce prepolymer (I) (average molecular weigh = 1100) having a reaction rate of 95%. Prepolymer (I); ethylacrylate; and acetone were mixed in a weight ratio of 5:15:80. The above paper board was dipped in the above mixture for about 10 seconds, and the sample was placed in an aluminium-bag having a polyethylene backing, the weight of which was previously measured. Nitrogen gas was blown into the bag to purge air out, and the bag was sealed. The weight of the bag including the sample therein was measured, and the amount of the resinous solution impregnated in the sample was calculated to be 0.327 g. The sample in the bag was put on a conveyer belt running at 0.72 m/min, and was irradiated by 5 M rads of electron radiation emitted from Van de Graaff electrostatic accelerator (1.5 MeV, 50 $\mu$A, dose rate = 0.25 M rad/sec). After irradiation, the sample taken out from the aluminium-bag was placed in a vacuum drier at 70° C for 24 hours, and the unreacted monomers and solvent were then removed. The sample was then seasoned in an air of 65% relative humidity at 20° C. The weight of the resultant sample was 1.907 g. The polymerization rate of ethylacrylate impregnated was 99%, and the amount of polymer thus coated on the paper board was 7.2 g/m$^2$. The surface of the paper board thus treated was smooth. This sample was then tested with respect to dry tensile strength (Note 1) and ring crush strength (Note 2) and the values of the tensile strength and ring crush strength were respectively 34.7 kg and 35.0 kg, while the tensile strength and ring crush strength of the same type of paper but untreated were respectively 31.8 kg and 32.1 kg. Thus, the treated paper has a little higher strength than the untreated paper. This sample was further tested with respect to wet tensile strength (Note 3) and ring crush strength (Note 4), and the values of the tensile strength and ring crush strength were respectively 10.3 and 8.0 kg, while the wet tensile strength and ring crush strength of the same type of paper but untreated were respectively 3.2 and 2.5 kg. Thus, the treated paper has a considerably higher strength than the untreated paper. The dry folding strength (Note 5) of the above treated paper board was 400 times, while that of an untreated paper board was 850 times. However, this is no trouble on its practical use.

Various paper board were prepared by changing the amount of polymer to be applied and dose of electron radiation, and were tested with respect to wet the tensile strength, wet ring crush strength, dry folding strength and water absorption (Note 6). The results of the tests are shown in Table 1.

Table 1

| Weight ratio of prepolymer to monomer used | Amount of polymer to be applied to obtain 10 kg wet tensile strength (g/m$^2$) | Dry folding strength of the paper board treated so as to give 10 kg wet tensile strength (times) | Amount of polymer to be applied to obtain 10 kg wet ring crush strength (g/m$^2$) | Water absorption of the paper board treated so as to give 10 kg wet tensile strength (%) |
|---|---|---|---|---|
| Prepolymer (I) (average molecular weight = 1100) : ethylacrylate = 1 : 3 | 7.0 | 400 | 9.0 | 48 |

Comparative paper boards were prepared respectively by using a solution containing prepolymer (I) alone (containing no ethylacrylate) (weight ratio of prepolymer to acetone = 10:90) and a solution containing ethylacrylate alone (containing no prepolymer) (weight ratio of ethylacrylate to methanol = 60:40). Various tests were carried out with these comparative paper board, and the results are shown in Table 2.

Table 2

| Treating solution | Amount of polymer to be applied to obtain 10 kg wet tensile strength ($g/m^2$) | Dry folding strength of the paper board treated so as to give 10 kg wet tensile strength (times) | Amount of polymer to be applied to obtain 10 kg wet ring crush strength ($g/m^2$) | Water absorption of the paper board treated so as to give 10 kg wet tensile strength (%) |
|---|---|---|---|---|
| Prepolymer (I) alone | 7.0 | 200 | — | 40 |
| Ethylacrylate alone | 54 | 21 | — | 23 |

It is obvious from the above tables that the paper board treated with a mixture of prepolymer (average molecular weight = 1100) and ethylacrylate is highly improved in the amount of polymer required and dry folding strength as compared to the paper board treated with a solution containing prepolymer or ethylacrylate alone.

Note 1

Dry tensile strength

The test was conducted by using a TM-M type Instron tester under the following conditions.

Size of sample: 100 mm (length) × 15 mm (width)
Length of span: 70 mm
Tensile rate: 10 mm/min The sample was seasoned in an atmosphere of 65% relative humidity at 20° C.

Note 2

Dry ring crush strength

The test was conducted by using a TM-M type Instron tester under the following conditions.

Size of sample: 152.4 mm (length) × 12.7 mm (width)
Compression rate: 10 mm/min

The sample was seasoned in an atmosphere of 65% relative humidity at 20° C.

Note 3

Wet tensile strength

The test was conducted by using a TM-M type Instron tester.

The sample was tested immediately after being immersed in water at 20° C for 10 minutes. The other testing conditions were the same as those of Note 1.

Note 4

Wet ring crush strength

The test was conducted by using a TM-M type Instron tester.

The sample was tested immediately after being immersed in water at 20° C for 60 minutes. The other testing conditions were the same as those of Note 2.

Note 5

Dry folding strength

The test was conducted by using a MIT folding tester.

Size of sample: 100 mm (length) × 15 (width)
Folding angle: 135° (respectively both right and left)
Folding rate: 175 double fold/min
Load: 1 kg The sample was seasoned in an atmosphere of 65% relative humidity at 20° C.

Note 6

Water absorption

The sample was immersed in water at 20° C for 10 minutes, and the superfluous water was squeezed through a filter paper. The water absorption was calculated from the difference in the weight of the sample before and after the immersion.

EXAMPLE 2

Prepolymer (I) (average molecular weight = 1,100); ethylacrylate; and acetone were mixed in a weight ratio of 8:12:80 to prepare a treating solution. A sample paper board was treated and tested in the same manner as Example 1. The results are shown in Table 3.

Table 3

| Weight ratio of prepolymer to monomer used | Amount of polymer to be applied to obtain 10 kg wet tensile strength ($g/m^2$) | Dry folding strength of the paper board treated so as to give 10 kg wet tensile strength (times) | Amount of polymer to be applied to obtain 10 kg wet ring crush strength ($g/m^2$) | Water absorption of the paper board treated so as to give 10 kg wet tensile strength (%) |
|---|---|---|---|---|
| Prepolymer (I) : ethylacrylate = 2 : 3 | 10.7 | 240 | — | 42 |

It is clear from the above table that when the ratio of ethylacrylate is lowered, the amount of polymer required is increased and dry folding strength is reduced in comparison with Example 1.

EXAMPLE 3

Prepolymer (I) (average molecular weight = 1,100); ethylacrylate; and acetone were mixed in a weight ratio of 5:35:60 to prepare a treating solution. A sample paper board was treated and tested in the same manner as Example 1. The results are shown in Table 4.

Table 4

| Weight ratio of prepolymer to monomer used | Amount of polymer to be applied to obtain 10 kg wet tensile strength ($g/m^2$) | Dry folding strength of the paper board treated so as to give 10 kg wet tensile strength (times) | Amount of polymer to be applied to obtain 10 kg wet ring crush strength ($g/m^2$) | Water absorption of the paper board treated so as to give 10 kg wet tensile strength (%) |
|---|---|---|---|---|
| Prepolymer (I) : ethylacrylate = 1 : 7 | 12.5 | 300 | — | 45 |

As can be seen from the above table, when a ratio of ethylacrylate is increased, polymer required is increased in comparison with Example 1 and dry folding strength is a little improved in comparison with Example 2.

EXAMPLE 4

In the former Examples 1, 2 and 3, ethylacrylate was used as a monomer, but in Example 4 methylacrylate was used as a monomer. Prepolymer (I) (average molecular weight = 1,100); methylacrylate; and acetone were mixed in a weight ratio of 5:15:80 to prepare a treating solution. A sample paper board was treated and tested in the same manner as Example 1. The results are shown in Table 5.

Table 5

| Weight ratio of prepolymer to monomer used | Amount of polymer to be applied to obtain 10 kg wet tensile strength ($g/m^2$) | Dry folding strength of the paper board treated so as to give 10 kg wet tensile strength (times) | Amount of polymer to be applied to obtain 10 kg wet ring crush strength ($g/m^2$) | Water absorption of the paper board treated so as to give 10 kg wet tensile strength (%) |
|---|---|---|---|---|
| Prepolymer (I) : methylacrylate = 1 : 3 | 11.1 | 290 | 13.5 | 51 |

A comparative paper board was prepared by using a solution containing methylacrylate alone (containing no prepolymer) (weight ratio of methylacrylate to methanol = 40:60), and was tested in the same manner as Example 1. The results are shown in Table 6.

Table 6

| Treating solution | Amount of polymer to be applied to obtain 10 kg wet tensile strength ($g/m^2$) | Dry folding strength of the paper board treated so as to give 10 kg wet tensile strength (times) | Amount of polymer to be applied to obtain 10 kg wet ring crush strength ($g/m^2$) | Water absorption of the paper board treated so as to give 10 kg wet tensile strength (%) |
|---|---|---|---|---|
| Methylacrylate alone | 48 | 25 | — | 30 |

It is clear from the above table that the paper board treated with a solution containing methylacrylate alone has a very poor wet tensile strength and dry folding strength.

EXAMPLE 5

Prepolymer (I) (average molecular weight = 1,100); butylacrylate; and acetone were mixed in a weight ratio of 5:15:80 to prepare a treating solution. A sample paper board was treated and tested in the same manner as Example 1. The results are shown in Table 7.

Table 7

| Weight ratio of prepolymer to monomer used | Amount of polymer to be applied to obtain 10 kg wet tensile strength ($g/m^2$) | Dry folding strength of the paper board treated so as to give 10 kg wet tensile strength (times) | Amount of polymer to be applied to obtain 10 kg wet ring crush strength ($g/m^2$) | Water absorption of the paper board treated so as to give 10 kg wet tensile strength (%) |
|---|---|---|---|---|
| Prepolymer (I): butylacrylate = 1 : 3 | 7.5 | 280 | 9.8 | 45 |

The above test results were almost the same as those of Example 1, but the dry folding strength is lowered. A comparative paper board was prepared by using a solution containing butylacrylate alone (containing no prepolymer) (weight ratio of butylacrylate to methanol = 40:60), and was tested in the same manner as Example 1. The results are shown in Table 8.

Table 8

| Treating solution | Amount of polymer to be applied to obtain 10 kg wet tensile strength ($g/m^2$) | Dry folding strength of the paper board treated so as to give 10 kg wet tensile strength (times) | Amount of polymer to be applied to obtain 10 kg wet ring crush strength ($g/m^2$) | Water absorption of the paper board treated so as to give 10 kg wet tensile strength (%) |
|---|---|---|---|---|
| Butylacrylate alone | 32 | 30 | — | 25 |

It is obvious from the above table that the paper board treated with a solution containing butylacrylate alone has a very poor wet tensile strength and dry folding strength to the same degree as the paper board treated with a solution containing methylacrylate alone.

EXAMPLE 6

In the above Examples 1, 2, 3, 4 and 5, prepolymer (I) having a molecular weight of 1,100 was used, but in Example 6 prepolymer (II) (average molecular weight = 530) prepared by reacting bisphenol type diglycidyl ether (sold under the trade name of "Araldite GY-250" by Ciba-Geigy Co.) with acrylic acid in the presence of a polymerization inhibitor and esterification catalyst at a reaction rate of 96% was employed. This prepolymer (II); ethylacrylate; and acetone were mixed in a weight ratio of 5:15:80 to prepare a treating solution. A sample board was treated and tested in the same manner as Example 1. The results are shown in Table 9.

Table 9

| Weight ratio of prepolymer to monomer used | Amount of polymer to be used to obtain 10 kg wet tensile strength ($g/m^2$) | Dry folding strength of the paper board treated so as to give 10 kg wet tensile strength (times) | Amount of polymer to be applied to obtain 10 kg wet ring crush strength ($g/m^2$) | Water absorption of the paper board treated so as to give 10 kg wet tensile strength (%) |
|---|---|---|---|---|
| Prepolymer (II) : ethylacrylate = 1 : 3 | 14.2 | 250 | 10.1 | 46 |

As can be seen from this table, the amount of polymer to be applied to obtain 10 kg wet tensile strength is higher than that to be applied to obtain 10 kg wet ring crush strength. This is a different feature from those of Example 1 to 5.

EXAMPLE 7

Prepolymer (III) (average molecular weight = 2,100) was prepared by reacting bisphenol type diglycidyl ether (sold under a trade name of "Epikote 1004" by Shell Chemical Co.) with acrylic acid in the presence of a polymerization inhibitor and esterification catalyst at a reaction rate of 93%. This prepolymer (III); ethylacrylate; and acetone were mixed in a weight ratio of 5:15:80 to prepare a treating solution. A sample board was treated and tested in the same manner as Example 1. The results are shown in Table 10.

Table 10

| Weight ratio of prepolymer to monomer used | Amount of polymer to be used to obtain 10 kg wet tensile strength ($g/m^2$) | Dry folding strength of the paper board treated so as to give 10 kg wet tensile strength (times) | Amount of polymer to be applied to obtain 10 kg wet ring crush strength ($g/m^2$) | Water absorption of the paper board treated so as to give 10 kg wet tensile strength (%) |
|---|---|---|---|---|
| Prepolymer (III): ethylacrylate = 1 : 3 | 9.5 | 360 | 9.0 | 50 |

EXAMPLE 8

Prepolymer (IV) (average molecular weight = 475) was prepared by reacting aliphatic dicarboxylic acid type diglycidyl ester (sold under the trade name of "Shodine 550" by Showa Denko Co.) with acrylic acid in the presence of a polymerization inhibitor and esterification catalyst at a reaction rate of 95%. This prepolymer (IV); ethylacrylate; and methanol were mixed in a weight ratio of 5:15:80 to prepare a treating solution. A sample paper board was treated and tested in the same manner as Example 1. The results are shown in Table 11.

Table 11

| Weight ratio of prepolymer to monomer used | Amount of polymer to be applied to obtain 10 kg wet tensile strength ($g/m^2$) | Dry folding strength of the paper board treated so as to give 10 kg wet tensile strength (times) | Amount of polymer to be applied to obtain 10 kg wet ring crush strength ($g/m^2$) | Water absorption of the paper board treated so as to give 10 kg wet tensile strength (%) |
|---|---|---|---|---|
| Prepolymer (IV): ethylacrylate = 1 : 3 | 20.4 | 240 | — | 47 |

A comparative paper board was prepared by using a solution containing prepolymer (IV) alone (containing no ethylacrylate) (weight ratio of prepolymer to methanol = 10:90), and was tested in the same manner as Example 1. The results are shown in Table 12.

Table 12

| Treating solution | Amount of polymer to be applied to obtain 10 kg wet tensile strength ($g/m^2$) | Dry folding strength of the paper board treated so as to give 10 kg wet tensile strength (times) | Amount of polymer to be applied to obtain 10 kg wet ring crush strength ($g/m^2$) | Water absorption of the paper board treated so as to give 10 kg wet tensile strength (%) |
|---|---|---|---|---|
| Prepolymer (IV) alone | 31.2 | 1 | — | 82 |

EXAMPLE 9

Prepolymer (V) (average molecular weight = 400) was prepared by reacting polyepichlorhydrine diglycidyl ether (sold under the trade name of "Eponitto 012" by Nitto Kasei Co.) with acrylic acid in the presence of a polymerization inhibitor and esterification catalyst at a reaction rate of 95%. This prepolymer (V); ethylacrylate; and methanol were mixed in a weight ratio of 7:21:72 to prepare a treating solution. A sample paper board was treated and tested in the same manner as Example 1. The results are shown in Table 13.

Table 13

| Weight ratio of prepolymer to monomer used | Amount of polymer to be applied to obtain 10 kg wet tensile strength ($g/m^2$) | Dry folding strength of the paper board treated so as to give 10 kg wet tensile strength (times) | Amount of polymer to be applied to obtain 10 kg wet ring crush strength ($g/m^2$) | Water absorption of the paper board treated so as to give 10 kg wet tensile strength (%) |
|---|---|---|---|---|
| Prepolymer (V): ethylacrylate = 1 : 3 | 21.6 | 160 | — | 44 |

EXAMPLE 10

Prepolymer (VI) (average molecular weight 32 990) was prepared by reacting dimer acid modified bisphenol diglycidyl ether (sold under the trade name of "Epikote 872" by Shell Chemical Co.) with acrylic acid in the presence of a polymerization inhibitor and esterification catalyst at a reaction rate of 95%. This prepolymer (VI); ethylacrylate; and methanol were mixed in a weight ratio of 7:21:72 to prepare a treating solution. A sample paper board was treated and tested in the same manner as Example 1. The results are shown in Table 14.

Table 14

| Weight ratio of prepolymer to monomer used | Amount of polymer to be applied to obtain 10 kg wet tensile strength ($g/m^2$) | Dry folding strength of the paper board treated so as to give 10 kg wet tensile strength (times) | Amount of polymer to be applied to obtain 10 kg wet ring crush strength ($g/m^2$) | Water absorption of the paper board treated so as to give 10 kg wet tensile strength (%) |
|---|---|---|---|---|
| Prepolymer (VI): ethylacrylate = 1 : 3 | 18.1 | 160 | — | 44 |

We claim:

1. In a process for increasing the wet tensile strength and compression strength of paperboard by impregnating or coating said paperboard with a mixture of epoxy acrylate prepolymer in acrylic monomer and curing said mixture which process however results in a loss of dry folding strength, the improvement whereby the loss of dry folding strength is minimized by using as the mixture (i) a prepolymer having the chemical formula,

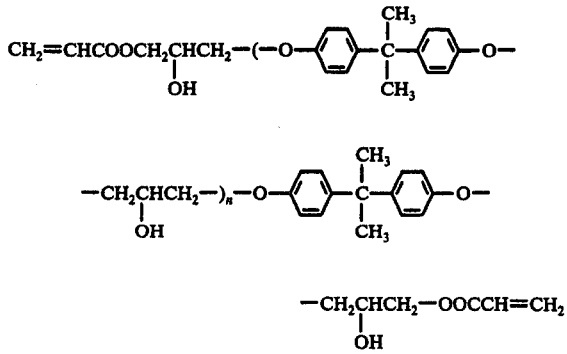

wherein $n = 1, 2, 3 \ldots$; the molecular weight of said prepolymer being 500 to 2,000 and (ii) at least one monomer selected from the group of methyl acrylate, ethyl acrylate and butyl acrylate, the weight ratio of prepolymer to monomer being 1:7 – 2:3.

2. The process of claim 1 wherein the monomer employed is ethyl acrylate, the molecular weight of the prepolymer is 1,100 and the weight ratio of prepolymer to ethyl acrylate is 2:3.

3. The process of claim 1 wherein the monomer employed is ethyl acrylate, the molecular weight of the prepolymer is 1,100 and the weight ratio of prepolymer to ethyl acrylate is 1:7.

4. The product of the process of claim 1.

5. The product of the process of claim 2.

6. The product of the process of claim 3.

7. The process of claim 1 wherein said curing is performed by irradiating said impregnated or coated paperboard with electrons.

* * * * *